US008833255B2

(12) United States Patent
Derhardt et al.

(10) Patent No.: US 8,833,255 B2
(45) Date of Patent: Sep. 16, 2014

(54) SHEET-FED PERFECTING PRINTING PRESS WITHOUT SHEET REVERSAL

(75) Inventors: Steffen Derhardt, Gerlingen (DE); Peter Hachmann, Weinheim-Hohensachsen (DE); Ralf Thiele, Brandenburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 28 days.

(21) Appl. No.: 13/295,267

(22) Filed: Nov. 14, 2011

(65) Prior Publication Data

US 2012/0118185 A1 May 17, 2012

(30) Foreign Application Priority Data

Nov. 11, 2010 (DE) ..... 10 2010 051 030

(51) Int. Cl.
*B41F 5/02* (2006.01)
*B41F 21/10* (2006.01)
*B41F 7/02* (2006.01)
*B41F 7/06* (2006.01)

(52) U.S. Cl.
CPC ..... *B41F 21/10* (2013.01); *B41F 7/025* (2013.01); *B41F 7/06* (2013.01)
USPC ..... 101/229; 101/216

(58) Field of Classification Search
CPC ..... B41F 7/06
USPC ..... 101/229
See application file for complete search history.

(56) References Cited

U.S. PATENT DOCUMENTS

| | | | | | |
|---|---|---|---|---|---|
| 1,757,901 | A | * | 5/1930 | Cox | 101/221 |
| 3,384,011 | A | * | 5/1968 | Bolza-Schunemann | 101/177 |
| 4,493,255 | A | * | 1/1985 | Fischer | 101/183 |
| 4,932,321 | A | * | 6/1990 | Hermach | 101/211 |
| 4,967,660 | A | * | 11/1990 | Yamanari et al. | 101/229 |
| 5,555,804 | A | | 9/1996 | Kojima | |
| 5,623,873 | A | * | 4/1997 | Ikeda | 101/137 |
| 6,314,882 | B1 | * | 11/2001 | Petersen | 101/219 |
| 6,338,299 | B1 | * | 1/2002 | Kamoda et al. | 101/424.1 |

(Continued)

FOREIGN PATENT DOCUMENTS

| | | |
|---|---|---|
| DE | 44 22 390 A1 | 1/1995 |
| DE | 698 09 677 T2 | 9/2003 |

(Continued)

OTHER PUBLICATIONS

German Patent and Trademark Office Search Report, Dated Jun. 21, 2011.

*Primary Examiner* — Anthony Nguyen
(74) *Attorney, Agent, or Firm* — Laurence A. Greenberg; Werner H. Stemer; Ralph E. Locher

(57) ABSTRACT

A sheet-fed, rotary, printing press for printing on both sides of sheets without a sheet reversing device, includes printing units having a modular construction. Each module includes at least a plate cylinder, a blanket cylinder, an impression cylinder, a transfer cylinder and at least one drive wheel. Modules for printing on the first side of the sheets and modules for printing on the second side of the sheets have an identical construction and are disposed in such a way that one is rotated through 180° relative to the other about an axis extending in a sheet processing direction.

3 Claims, 4 Drawing Sheets

(56) References Cited

U.S. PATENT DOCUMENTS

| | | | | |
|---|---|---|---|---|
| 6,431,065 | B1 | 8/2002 | Demi et al. | |
| 6,772,709 | B2 * | 8/2004 | Shibata | 118/46 |
| 6,901,335 | B2 * | 5/2005 | Wang et al. | 702/35 |
| 7,152,527 | B2 | 12/2006 | Dejima et al. | |
| 7,325,493 | B2 | 2/2008 | Helmstädter et al. | |
| 2002/0023558 | A1 * | 2/2002 | Kusunoki | 101/221 |
| 2002/0083853 | A1 * | 7/2002 | Merz et al. | 101/216 |
| 2007/0101879 | A1 * | 5/2007 | Hajek et al. | 101/219 |

FOREIGN PATENT DOCUMENTS

| | | | |
|---|---|---|---|
| DE | 600 05 745 | T2 | 8/2004 |
| EP | 0 906 826 | A2 | 4/1999 |
| EP | 1 281 518 | A2 | 2/2003 |

* cited by examiner

SHEET-FED PERFECTING PRINTING PRESS WITHOUT SHEET REVERSAL

CROSS-REFERENCE TO RELATED APPLICATION

This application claims the priority, under 35 U.S.C. §119, of German Patent Application DE 10 2010 051 030.0, filed Nov. 11, 2010; the prior application is herewith incorporated by reference in its entirety.

BACKGROUND OF THE INVENTION

Field of the Invention

The invention relates to a sheet-fed, rotary, printing press for perfecting printing without a sheet reversing device. The printing press includes a number of printing units having a modular structure.

It is known that the modules for printing on the first side of the sheets have a different structure, in particular a different cylinder configuration, than the modules for printing on the second side of the sheets. For reasons of simplicity of the present description, modules for printing on the first side of the sheets will be referred to herein as first-side printing modules and printing modules for printing on the second side of the sheets will be referred to as second-side printing modules.

A sheet-fed, rotary, printing press of that type is known, for instance, from European Published Patent Application EP 1 281 518 A2, corresponding to U.S. Pat. No. 7,152,527.

SUMMARY OF THE INVENTION

It is accordingly an object of the invention to provide a sheet-fed perfecting printing press, i.e. a printing press for printing on both sides of a sheet, that does not include a sheet reversing device, which overcomes the hereinafore-mentioned disadvantages of the heretofore-known devices of this general type and which has elementarily identical printing modules for printing on a first side and for printing on a second side of the sheets.

With the foregoing and other objects in view there is provided, in accordance with the invention, a perfecting, sheet-fed, rotary printing press transporting sheets to be printed without being turned. The printing press comprises a drive side and an operator side defining an axis extending in a sheet processing direction. Printing units having a modular structure include at least one transfer cylinder, an impression cylinder, a blanket cylinder, a plate cylinder and at least one drive wheel disposed in modules. The modules have the same structure and include a module for printing on a first side of the sheets and a module for printing on a second side of the sheets. The module for printing on the first side of the sheets is disposed in a position which is rotated through 180° about the axis, as compared to the module for printing on the second side of the sheets. The at least one drive wheel that is disposed on the drive side is disposed on the operator side after being rotated.

It is a particular advantage for the printing modules of a sheet-fed printing press to be identical to the greatest possible extent as proposed by the invention, because such a measure is a way of cutting manufacturing costs.

In accordance with the invention, the modules advantageously have an identical cylinder configuration of a sheet transport cylinder, an impression cylinder, a blanket cylinder, a plate cylinder interacting with the blanket cylinder and carrying the image to be printed, and at least one drive wheel connected to a drive train of the printing press.

In accordance with a particularly advantageous feature of the invention, the cylinders of a printing module may include drive gears that are disposed on the same side with respect to the printing unit.

When a printing press according to the invention is being assembled, it is possible to place the printing modules for printing on the first side of the sheets next to further printing modules for printing on the first side, but also next to printing units for printing on the second side of the sheets. As compared to the printing modules for printing on the first side of the sheets, the printing modules for printing on the second side have been rotated through 180° about an axis extending in the sheet processing direction (i.e. they are disposed upside down) so that the drive gears of the cylinders of a printing module for printing on the first side of the sheets are on the drive side and the drive gears of the cylinders of a printing module for printing on the second side of the sheets are on the operator side of the sheet-fed rotary printing press.

If a first-side printing module is disposed next to a second-side printing module, at least one transfer cylinder, preferably three transfer cylinders, are provided. The transfer cylinder or, if three transfer cylinders are present, at least one transfer cylinder, has a drive gear on one side (the drive side) and on the other side (the operator side).

The printing units can be individually equipped with inking or varnishing units. The inking units may be conventional inking/dampening units or short inking units.

Other features which are considered as characteristic for the invention are set forth in the appended claims.

Although the invention is illustrated and described herein as embodied in a sheet-fed perfecting printing press without sheet reversal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
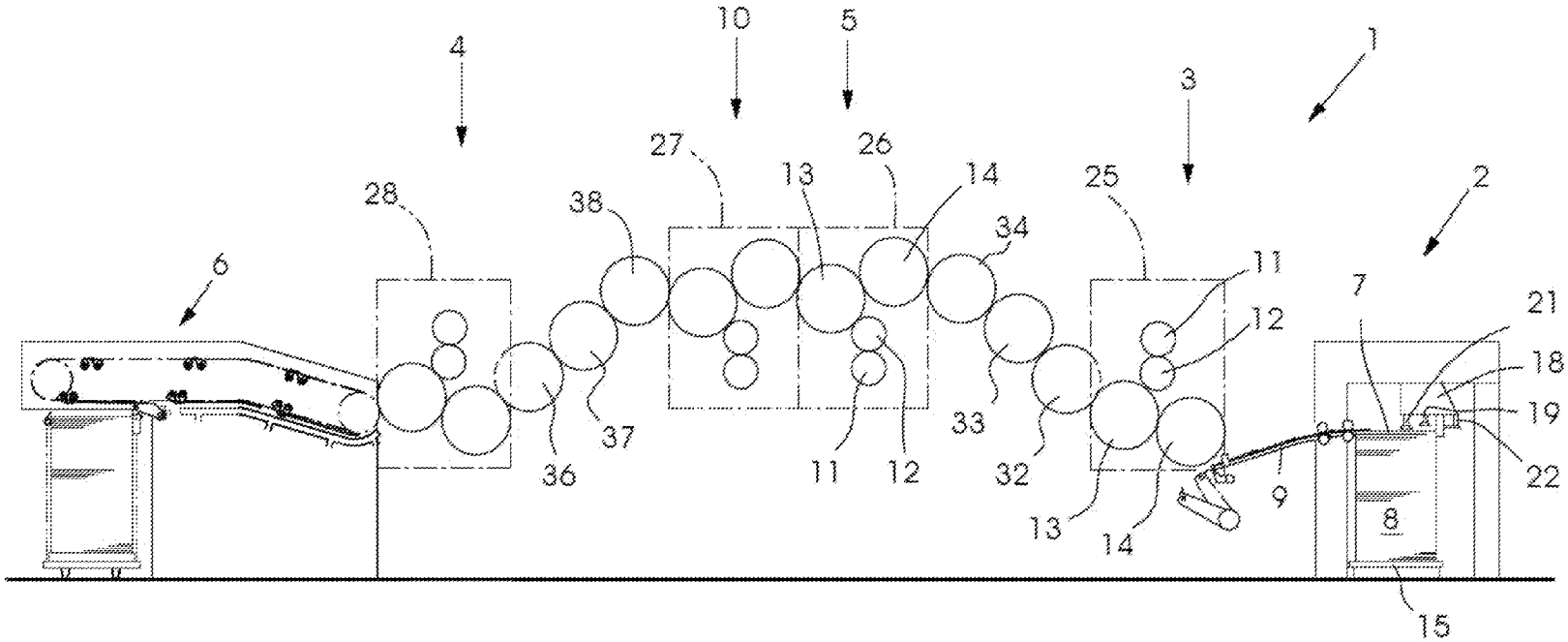
FIG. 1 is a diagrammatic, longitudinal-sectional view of a sheet-fed rotary printing press.

Referring now to the figures of the drawings in detail and first, particularly, to FIG. 1 thereof, there is seen a machine 1, such as a printing press, for processing sheets 7, which includes a feeder 2, a number of printing units 3, 4 for printing on a first side of the sheets, a number of printing units 5, 10 for printing on a second side of the sheets and a delivery 6.

The sheets 7 are taken from a stack 8 of sheets and are fed to the printing unit 3 as individual sheets 7 or as a shingled stream of sheets 7 over a feed table 9. The printing unit 3 includes a plate cylinder 11, a blanket cylinder 12, an impression cylinder 13 and a transfer cylinder 14, as are known in the art. Each of the plate cylinders 11 of the first-side printing units 3, 4 and the second-side printing units 5, 10 includes a device for clamping flexible printing plates. In addition, a device for semi-automatic or fully automatic plate change is associated with each of the plate cylinders 11.

The stack of sheets 8 rests on a stack plate 15 that can be lifted in a controlled manner. The sheets 7 are taken from the top side of the sheet stack 8 by a so-called suction head 18 which includes, among other parts, a number of lifting and dragging suction elements 19, 21 for separating the sheets 7. In addition, blowers 22 for assisting in the separation of the upper sheets and sensing elements for a controlled lifting of the stack are provided.

FIG. 1 illustrates a printing press that is constructed in accordance with the invention. The printing press includes a first printing module 25 for printing on the first side of the sheets, which will be referred to as a first-side printing module, first and last printing modules 26, 27 for printing on the second side of the sheets (also referred to as second-side printing modules) disposed in line with the first printing module 25, and a second printing module 28 for printing on the first side of the sheets provided downstream of the second-side printing modules 26, 27. At least one transfer cylinder 34, preferably three transfer cylinders 32, 33, 34, are provided between the first first-side printing module 25 and the first second-side printing module 26. The same applies to the transfer of the sheets from the last second-side printing module 27 to the second first-side printing module 28. At this location, there is likewise at least one transfer cylinder 38, preferably three transfer cylinders 36, 37, 38.

Every module, i.e. both the modules for first-side printing and the modules for second-side printing, includes a frame that is formed of at least two side walls and supports at least four cylinders, i.e. the transfer cylinder 14, the impression cylinder 13, the blanket cylinder 12 and the plate cylinder 11. The angular configuration of the cylinders in the side frames is the same for all of the modules.

Figure 2:
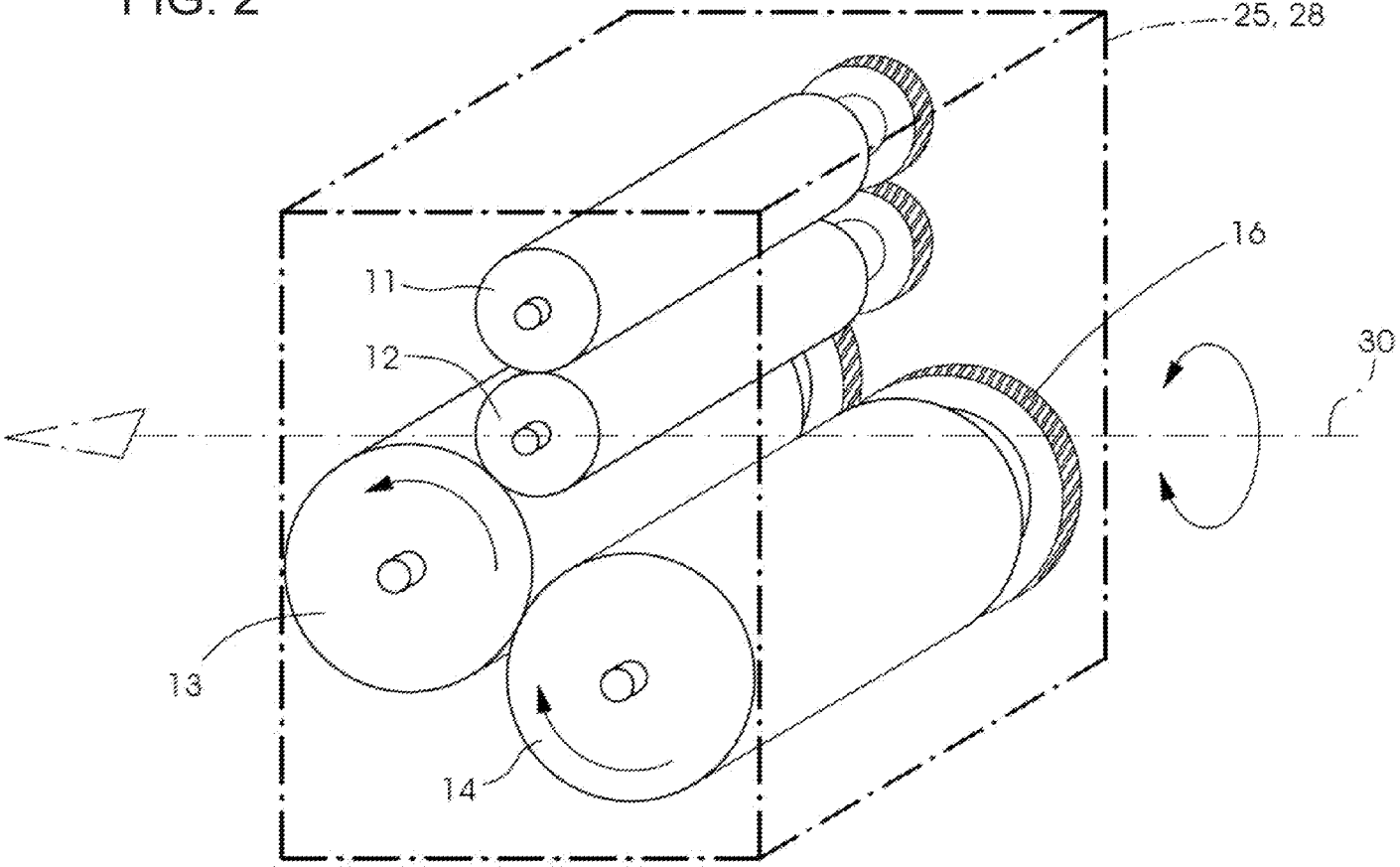
FIG. 2 is a perspective view of a basic module of a printing unit for printing on a first side of the sheets.
Figure 3:
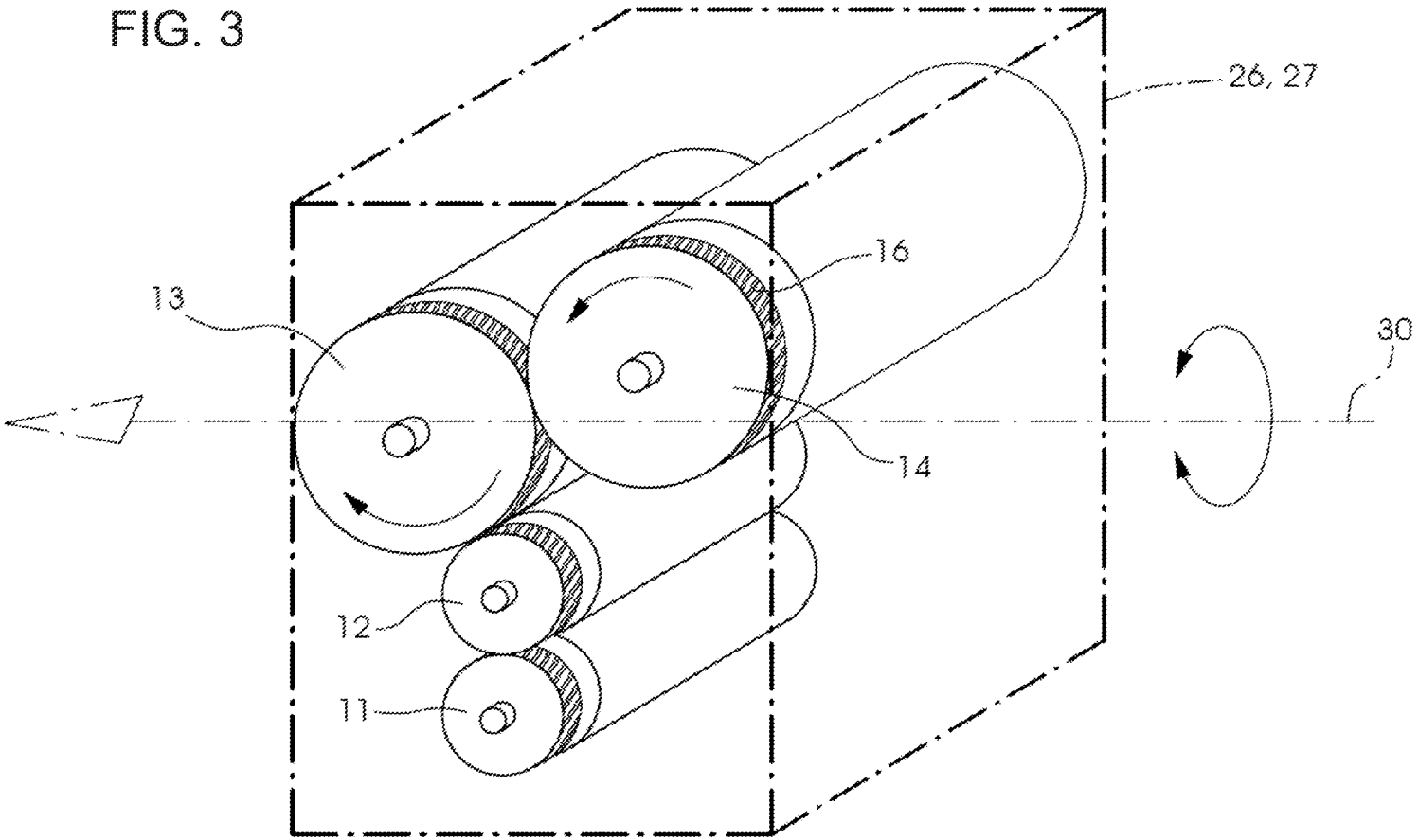
FIG. 3 is a perspective view of a basic module for printing on a second side of the sheets.

As is seen in FIGS. 2 and 3, at least the transfer cylinder 14 has a drive wheel 16 that is disposed in the drive train of the printing press 1. Preferably, the other cylinders 11-13 likewise have drive wheels for establishing a driving connection.

A special feature of the first-side printing modules 25, 28 shown in FIG. 2 is that the blanket cylinders 12 and the plate cylinders 11 are disposed above a sheet transport path. In the second-side printing modules 26, 27 shown in FIG. 3, the blanket cylinders 12 and the plate cylinders 11 are disposed below the sheet transport path. In order to achieve this configuration, a second-side printing module has been rotated, as compared to a first-side printing module, through 180° about an axis 30 that extends in a sheet processing direction. The result is an upside-down configuration. Due to this measure, the transfer cylinder 14 of the first-side and second-side printing modules will always be disposed upstream of the impression cylinder 13, as viewed in the direction of sheet travel.

The cylinders 11 to 14 are assigned drive wheels 16. In the first-side printing module, these drive wheels 16 are disposed on the right-hand side as viewed in the direction of sheet travel, i.e. on the conventional drive side AS. Due to the rotation through 180°, the drive wheels 16 move to the operator side BS of the printing press 1.

Figure 4:
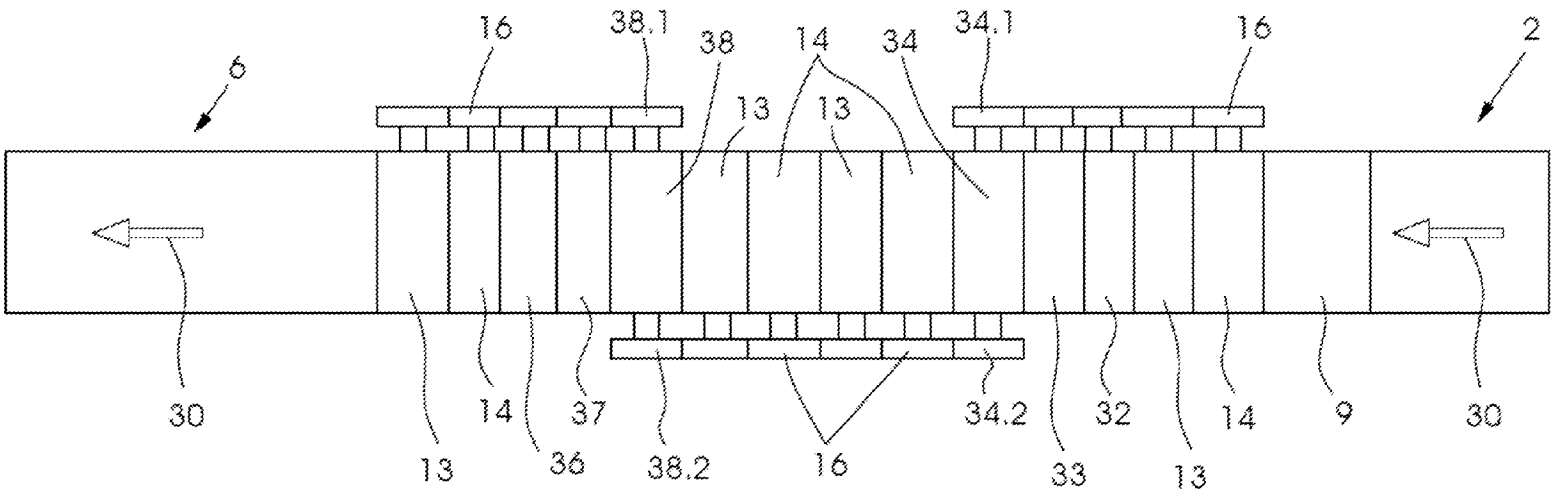
FIG. 4 is a top-plan view of the rotary printing press shown in FIG. 1.

As is seen in FIG. 4, if a first-side printing module 25, 28 is disposed next to a second-side printing module 26, 27, in order to provide a continuous drive train, the transfer cylinders 34, 38 that are disposed between the first-side printing module 25, 28 and the second-side printing modules 26, 27 include respective drive wheels 34.1, 34.2, 38.1, 38.2 on the drive side and on the operator side.

Of course, it is technically possible to construct the impression cylinder 13 or the transfer cylinders 14 as synchronization cylinders for transferring the torque from the drive side to the operator side by assigning a drive wheel to the operator side and to the drive side of one of these sheet transport cylinders. First-side printing modules that directly follow each other and second-side printing modules that directly follow each other do not require the second drive wheel because no change of sides is required for torque transfer purposes.

The printing modules 25, 28, 26 and 27 may be individually equipped with inking or varnishing units. The inking units may be conventional inking/dampening units or short inking units.

The invention claimed is:

1. A perfecting, sheet-fed, rotary printing press transporting sheets to be printed without being turned, the printing press comprising:

a drive side and an operator side defining an axis extending in a sheet processing direction;

printing units having a modular structure and including at least one transfer cylinder, an impression cylinder, a blanket cylinder, a plate cylinder and at least one drive wheel disposed in modules;

said modules having the same structure and including a module for printing on a first side of the sheets and a module for printing on a second side of the sheets;

said module for printing on the first side of the sheets being disposed in a position being rotated through 180° about said axis, compared to a position of said module for printing on the second side of the sheets;

said at least one drive wheel of said modules being disposed on said drive side for printing on one side of the sheets and on said operator side for printing on the other side of the sheets;

another transfer cylinder disposed between said module for printing on the first side of the sheets and said module for printing on the second side of the sheets, said other transfer cylinder having two sides; and two drive wheels each disposed on a respective one of said two sides of said other transfer cylinder.

2. The sheet fed rotary printing press according to claim 1, which further comprises two additional transfer cylinders disposed between said module for printing on the first side of the sheets and said module for printing on the second side of the sheets.

3. The sheet fed rotary printing press according to claim 1, wherein said modules that are disposed in said positions being rotated through 180° about said axis are configured to be located in a position for printing on the first side of the sheets or a position for printing on the second side of the sheets.

* * * * *